US005693162A

United States Patent [19]

Gustafsson et al.

[11] Patent Number: 5,693,162

[45] Date of Patent: Dec. 2, 1997

[54] METHOD FOR MANUFACTURING AN ABSORBENT FIBRE LAYER, AND AN ABSORBENT FIBRE LAYER

[75] Inventors: Helmer Gustafsson, Valkeakoski, Finland; Stephan Favre, Risskov, Denmark

[73] Assignee: Yhtyneet Paperitehtaat Oy, Valkeakoski, Finland

[21] Appl. No.: 383,228

[22] Filed: Feb. 3, 1995

[30] Foreign Application Priority Data

Feb. 3, 1994 [FI] Finland ..... 940508

[51] Int. Cl.[6] ..... B27N 3/00

[52] U.S. Cl. ..... 156/62.2; 156/62.6; 156/296; 156/308.2; 156/308.8

[58] Field of Search ..... 156/62.2, 62.6, 156/296, 308.2, 308.8

[56] References Cited

U.S. PATENT DOCUMENTS 5,171,391 12/1992 Chmielewski et al. ..... 156/229
5,281,207 1/1994 Chmielewski et al. ..... 604/378

FOREIGN PATENT DOCUMENTS 0 159 630 10/1985 European Pat. Off. .
0 480 724 4/1992 European Pat. Off. .
0 492 544 7/1992 European Pat. Off. .

*Primary Examiner*—James J. Bell
*Attorney, Agent, or Firm*—Young & Thompson

[57] ABSTRACT

The invention relates to a method for manufacturing an absorbent fibre layer (15), and an absorbent fibre layer. In the method, at least one material layer (16) consisting of a mixture of natural fibres, such as wood fibres, and plastic fibres is formed by a dry-forming technique, and at least one other material layer (17) consisting of natural fibres, or a mixture of natural fibres and plastic fibres, and superabsorbent material (18) is formed on said material layer. The fibre layer (15) is bonded with heat. The invention is characterized in that the superabsorbent material (18) is added to the second material layer (17) to be formed in connection with its dry-forming stage, after which the upper surface of the fibre layer is compacted and its lower surface is moistened and compressed by hot calendering in order to compress the material layer (16) comprising no superabsorbent material into a liquid-spreading layer.

6 Claims, 1 Drawing Sheet

METHOD FOR MANUFACTURING AN ABSORBENT FIBRE LAYER, AND AN ABSORBENT FIBRE LAYER

FIELD OF THE INVENTION

The invention relates to a method for manufacturing an absorbent fibre layer, in which method at least one material layer consisting of a mixture of natural fibres, such as wood fibres, and synthetic fibres is formed by a dry-forming technique, and at least one other material layer consisting of natural fibres, or a mixture of natural fibres and synthetic fibres, and superabsorbent material is formed on said material layer, and which fibre layer is bonded with heat.

The invention also relates to an absorbent fibre layer manufactured by means of the method.

BACKGROUND OF THE INVENTION

When non-woven sanitary products are manufactured, an absorbent layer is formed by a dry-forming technique of natural fibre to which a bonding agent or bonding fibres are added to bond the formed material web into a porous fibre layer by the action of heat. A necessary number of such layers are formed on top of each other depending on the desired thickness of the product.

Material layers formed in this manner are used in the manufacturing of different types of diapers, sanitary napkins and hospital wound dressings. The problem with products of this type is their limited absorbing capacity, which is also often incompatible with the efforts to diminish the size of the product. Such absorbent sanitary products are also known that comprise superabsorbent material which is added to improve the absorbing capacity. Although the absorbing capacity in such products has improved, the different layers of fibre, reinforcing material and superabsorbent material included in the same product make the products relatively expensive and complicate the manufacturing process.

SUMMARY OF THE INVENTION

The purpose of this invention is to provide a method for manufacturing, in a simple manner, a fibre layer with a high absorbing capacity. To achieve this, the method according to the invention is characterized in that the superabsorbent material is added in connection with the dry-forming stage of the second material layer to be formed, after which the upper surface of the fibre layer is compacted and its lower surface is moistened and compressed by hot calendering in order to compress the material layer comprising no superabsorbent material into a liquid-spreading layer.

The material web can be preferably hot-calendered by means of patterning facilitating the transportation of liquid to desired parts of the absorbent layer and providing rapid liquid transportation conduits on the compressed side of the fibre layer to different parts of the final product.

A preferred product according to the invention is thus substantially a result of the interaction of two factors. Firstly, the fibre layer is made of substantially one layer, even though it is formed in several stages. Secondly, this one layer comprises both the required absorbent layer, formed by adding superabsorbent material to one side, and the liquid-spreading layer, formed by compressing the other side in a suitable manner.

These two factors thus surprisingly result in a highly absorbent and at the same time easily manufacturable fibre layer, which comprises no concentrations of particles or other material weakening the mechanical resistance, nor joints formed by several superimposed webs.

Other preferred embodiments of the method according to the invention are characterized by what is disclosed in the appended claims. The fibre layer according to the invention and its preferred embodiments are characterized by what is disclosed in the appended claims concerning it.

BRIEF DESCRIPTION OF THE DRAWINGS

In the following, the invention will be described by means of an example with reference to the accompanying drawings, in which.

DETAILED DESCRIPTION OF THE INVENTION

Figure 1:
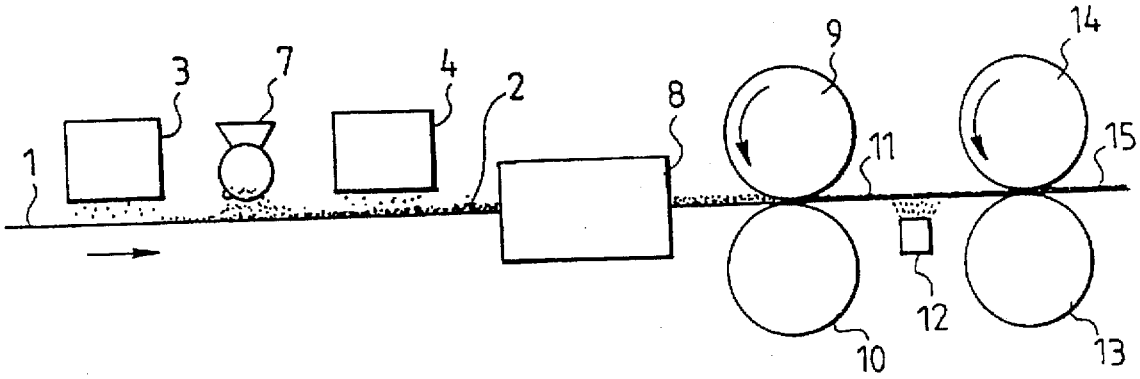
FIG. 1 shows the production line of a fibre layer according to the invention.

FIG. 1 shows a dry-forming line where a material web 2 is formed on a wire 1 in two stages by means of two formers 3 and 4. A mixture of air and fibre is blown into the formers, which extend transversely across the wire along its entire width, and the mixture is mixed and screened so as to form, according to a known technique, an even material layer on the wire 1 moving underneath. There can be as many formers as the desired layer thickness calls for, whereby one layer after another is formed on the same production line until the desired thickness is achieved. Furthermore, the ratio between wood fibres and polymer fibres in different layers may vary within the scope of the invention.

The wood fibres are preferably mechanical pulp of relatively long fibres, and the plastic fibres may be of any suitable thermobonding quality, for example bicomponent fibres the core of which is polypropylene and the mantle polyethylene.

Superabsorbent particles are added to the material web 2 either by means of a separate scattering device 7 or by adding the particles to the fibre material in the former 4. Suitable superabsorbent materials are for example activated carbon, activated clay, silica gels and cross-linked polyacrylates. The concentrations of different particles in the material web may be, for example: wood fibre (pulp fibre) 25–90%, plastic fibre 0–70% and superabsorbent particles 0–70%.

The superabsorbent may also be in liquid form, whereupon spray nozzles are used instead of the scattering device to spray for example acrylic acid monomer in water dispersion on the material web. The monomers are cross-linked by means of heat and suitable radicals, whereby the superabsorbent contributes to bonding the fibres together. Thus the amount of plastic fibres in this layer can be diminished or the plastic fibres can be completely left out as unnecessary.

After the forming stage, the material web is thermobonded and any possible liquid superabsorbent is cross-linked in a flow-through oven 8. After this, the upper surface of the bonded fibre layer 11 is compacted by a compactor 9,10 consisting of a heated calender roller 9 and its counter roller 10. The lower surface of the layer is moistened by a water nozzle 12 or a steam box and compressed by hot calendering by means of a calender roller 13 and its counter roller 14 to form a fibre layer 15 according to the invention.

Figure 2:
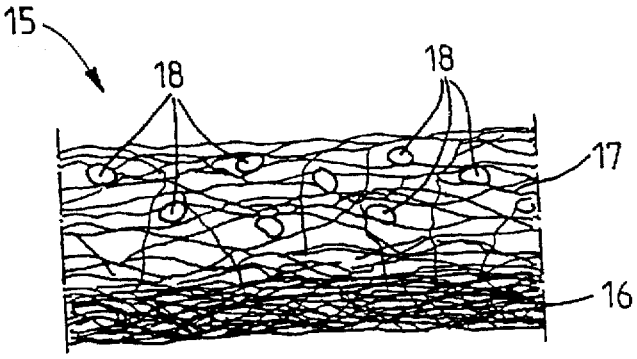
FIG. 2 shows an absorbent fibre layer according to the invention.

In the fibre layer of FIG. 2, the material layer 16 comprising no superabsorbent material is compressed into a liquid-spreading layer as a result of hot calendering. Liquid has been found to spread faster, up to a certain limit, in a more densely packed fibre layer than in a more porous fibre layer. This is due to the higher liquid transportation capacity of more densely organized fibres as compared with less densely packed fibres.

By exploiting this characteristic and by preferably forming patterns on the compressed side by a patterned calender roller, even faster liquid transportation conduits are provided to different parts of the product. The idea of the patterning is thus to form conduits to all parts of the product, the fibre structure in the conduits being further compressed to achieve a higher liquid transportation capacity, whereby the absorbing capacity of the product will be utilized to its optimum. The calendering may also be performed by means of a smooth roller, after which the final calendering of the fibre layer is performed by a patterned roller.

The fibre layer 15 according to the invention, shown in FIG. 2, thus comprises a lower material layer 16 consisting of a mixture of wood fibres and plastic fibres, and another material layer 17 formed on top of this and consisting of wood fibres, or a mixture of wood fibres and plastic fibres, and superabsorbent material 18. The superabsorbent material is shown in the figure in the form of particles. If fibrous or liquid superabsorbent material were used instead of the particles, such a substance could hardly be distinguished from the basic structure of the material, and therefore these alternatives are not shown separately.

It is apparent from the cross-section of FIG. 2 that the entire fibre layer 15 is substantially one and the same jointless layer, one side of which is the absorbent layer comprising superabsorbent material and the other side of which is the compressed liquid-spreading layer. The thickness of the layers can be varied and adjusted during the forming stage; the only essential thing is that the layers are formed on the same line and bonded together in one stage.

The final product formed of the fibre layer is cut into a suitable size and its lower surface is possibly coated with a plastic layer impervious to liquid. Other finishing measures are determined by the use of the product.

It is clear for one skilled in the art that the different embodiments of the invention are not limited to the examples described above, but they can vary within the scope of the appended claims.

We claim:

1. A method for manufacturing an absorbent fiber layer, the method comprising the steps of:

a) depositing a first mixture of natural fibers and synthetic fibers on a moving wire so as to form a first material layer by a dry-forming technique;

b) depositing on top of said first material layer while said first material layer is travelling on the moving wire a second mixture of natural fibers and superabsorbent material, or a mixture of natural fibers, synthetic fibers, and superabsorbent material so as to form by a dry-forming technique a material web;

c) thermobonding the material web to form substantially a single jointless product;

d) compacting the upper surface of said jointless product;

e) moistening the bottom surface of said jointless product; and f) compressing said jointless product by hot calendaring said bottom surface in order to compress said first material layer into a planar liquid transport layer and thereby obtain said absorbent fiber layer.

2. A method according to claim 1, wherein the natural fibers used to form the first material layer comprise wood fibers.

3. A method according to claim 1, wherein the hot calendering is performed by a patterned roller to provide patterning which facilitates the transportation of liquid in the plane of the liquid transport layer.

4. A method according to claim 1, wherein the hot calendering is initially performed by a smooth roller, after which a final calendering of the first material layer is performed by a patterned roller to provide patterning which facilitates the transportation of liquid in the plane of the liquid transport layer.

5. A method according to claim 1, wherein the superabsorbent material is added in the form of particles or fibers to a flow of fibers during step b).

6. A method according to claim 1, wherein the superabsorbent material is added in liquid form during step b).

* * * * *

UNITED STATES PATENT AND TRADEMARK OFFICE

CERTIFICATE OF CORRECTION

PATENT NO. : 5,693,162

DATED : December 2, 1997

INVENTOR(S) : Helmer GUSTAFSSON and Stephan FAVRE

It is certified that error appears in the above-indentified patent and that said Letters Patent is hereby corrected as shown below:

On the title, page, Item [75], change the first name of the second inventor from "STEPHAN" to --STEFAN--.

Signed and Sealed this

Second Day of June, 1998

*Attest:*

*Attesting Officer*

BRUCE LEHMAN

*Commissioner of Patents and Trademarks*